United States Patent [19]

Bortoli

[11] Patent Number: 4,848,785

[45] Date of Patent: Jul. 18, 1989

[54] BRAKE FOR SKIIS WITH ARMS FITTING WITHIN THE PLANE OF THE SKI AND BEING RAISED DURING NORMAL SKIING OPERATION

[76] Inventor: Ettore Bortoli, Via Calabria, 6, Thiene, Italy

[21] Appl. No.: 171,907

[22] Filed: Mar. 22, 1988

[30] Foreign Application Priority Data

Mar. 31, 1987 [IT] Italy ..... 85523 A/87

[51] Int. Cl.[4] ..... A63C 7/10

[52] U.S. Cl. ..... 280/605

[58] Field of Search ..... 280/605, 604, 601

[56] References Cited

U.S. PATENT DOCUMENTS

| | | | |
|---|---|---|---|
| 4,066,275 | 1/1978 | Martin | 280/605 |
| 4,279,432 | 7/1981 | Krob et al. | 280/605 |
| 4,521,032 | 6/1985 | Haldemann et al. | 280/605 |

FOREIGN PATENT DOCUMENTS

| | | | |
|---|---|---|---|
| 2357273 | 2/1978 | France | 280/605 |

*Primary Examiner*—Charles A. Marmor
*Assistant Examiner*—Michael Mar
*Attorney, Agent, or Firm*—Bucknam and Archer

[57] ABSTRACT

A brake for skiis is described which comprises a frame (12), a pair of arms (1 and 2) made of plastic elastic material, disposed in position corresponding to the rear of each of the skiis, a bracket (11) having wings (9 and 10). The bracket is connected to the frame. The brake comprises a rod (3) having rear ends and having two elbows (4 and 5) curved towards the interior, the rod rotating on the elbows (4 and 5) and widening at the end corresponding to the front of each of the skis in the shape of an omega (6). The ends of the arms are inserted within the rear ends of the rod, the bracket having shaped wings (9 and 10). The rod (3) rotates on point (7 and 8). The rod is held in place by the shaped wings, and is fixed to the device used for hooking each ski to boot. The arms are raised to an upper position fitting within the plane of the ski during the normal skiing operation and are lowered, diverge and penetrate into the snow when the boot becomes unhooked from the ski.

1 Claim, 1 Drawing Sheet

BRAKE FOR SKIS WITH ARMS FITTING WITHIN THE PLANE OF THE SKI AND BEING RAISED DURING NORMAL SKIING OPERATION

The present invention relates to brakes for skiis with arms which rise and fit totally along the width of the plane of the skiis. The brakes have an elastically deformable structure which guarantees by expansion, due to the elastic structure, preliminarily deformed after insertion of the boot, the return upwardly of the inclined plane located under the heel of the user, for instance, when the boot, for any reason, becomes unhooked from the couplings of the ski. In this manner, the braking arms are lowered and this simultaneously causes their divergence and their lowering. In this manner, the ski penetrates into the snow and the ski stops.

Many devices have been known for braking skiis when they have become unhooked from the boot of the user. They comprise braking arms which emerge downwardly and penetrate into the snow when the ski, for any reason, becomes unhooked from the boot of the user. For instance, there is known for this purpose, Italian Pat. No. 1,141,880, filed by the applicant on July 23, 1980. All the devices described for this purpose up to the present time require, however, the presence of a return spring, for instance, of the spiral type, as described in the Italian patent cited hereinabove. The springs are required for causing the lowering of the braking arms at the time when the latter must penetrate into the snow, and also, for the purpose of displacing the skiis towards the exterior when the brakes must exert their function, i.e., in the normal position of use of the skiis. The presence of the springs, unavoidabl, has some drawbacks, due to the fact that, because of the formation of ice, or in general clogging due to snow or dirt between the spirals of the springs, a fact which occurs frequently during use, the springs do not function properly and the device becomes useless.

In some devices used for braking, the fitting of the arms within the width of the plane of the skiis, due to the compression exerted by the boot, is accomplished with another device different from the device which provides for the return of the same arms upwardly. However, this return does not occur to completion and, therefore, also, the raising of the arms upwardly is not complete.

The object of the present invention is to provide a device for braking skiis which overcomes the drawbacks mentioned hereinabove, and which gives maximum guarantee at the time of use.

The crux of the present invention resides in the fact that the same structure which carries the brake is made by means of an element which comprises an elastic metallic rod suitably shaped, a structure which, due to its elasticity, functions as a return spring. In this manner, the structure, according to the present invention, cannot be blocked by snow or ice and, consequently, always offers maximum guarantee of perfect operation.

Another essential feature of the present invention is that the braking arms which rise due to the pressure exerted by the foot of the user fit completely within the width of the plane of the ski, and rise substantially with respect to the same plane, thus eliminating every possibility of undesired contact with the snow during skiing.

The invention is illustrated in more detail by reference to the accompanying drawings of which:

Figure 1:
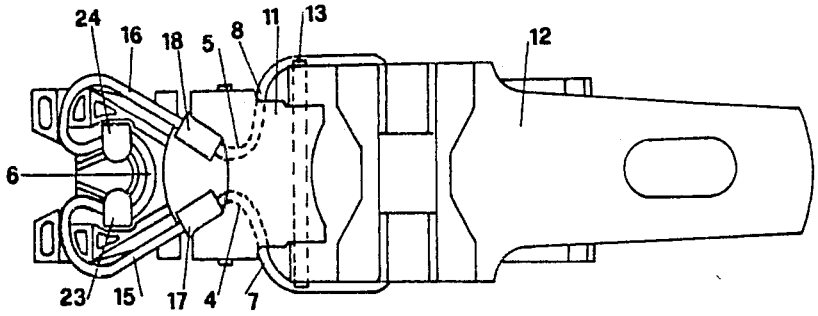
FIG. 1 is a bottom view of the brake of the present invention after it has been dismounted from the ski.
Figure 2:
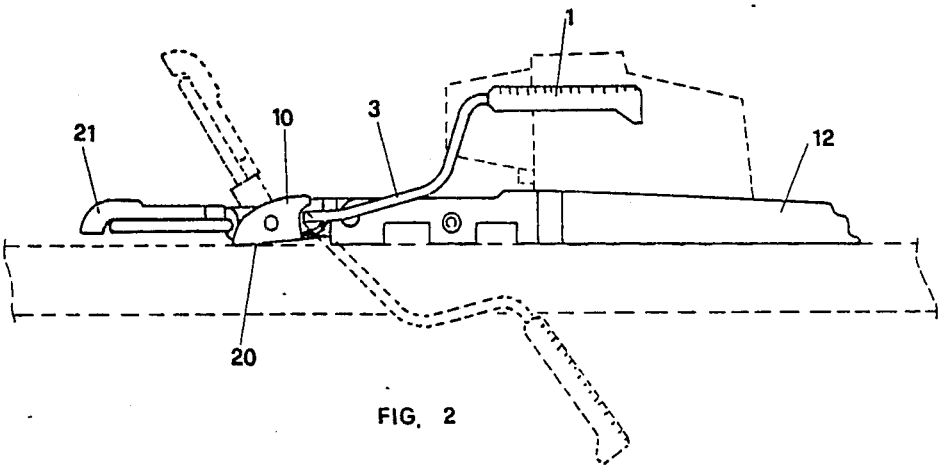
FIG. 2 is a side view of the brake after it has been mounted on a ski, the ski being represented by dotted lines.

As shown in the figures, the brake for the ski comprises two braking arms, 1 and 2, which consist of plastic sleeves inserted within the ends of rod 3, which forms two elbows, 4 and 5, curved towards the interior and subsequently diverge to fold in the shape of an omega at point 6, as shown in FIG. 1. In this manner, there is formed a structure which turns on pivots 7 and 8, where the rod is held by the shaped wings 9 and 10 of bracket 11 rigid with frame 12 of the device, being fixed by pin 13, which goes through the wings 14 and 14[1], emerging from the base plate.

In the rectilinear portion 15 and 16 of the rod, there are inserted the rotating idle rollers 17 and 18, which are preferably made of a suitable plastic material, which slide along cams 19 and 20 formed of an element integral with plate 11. In this manner, the arms of the brakes 1 and 2 are compelled to re-enter towards the interior of the plane of the ski when the device is brought into the normal skiing position, due to the pressure exerted by the boot of the user on the movable plate 21 which is connected with the elastic structure of the brake.

Figure 3:
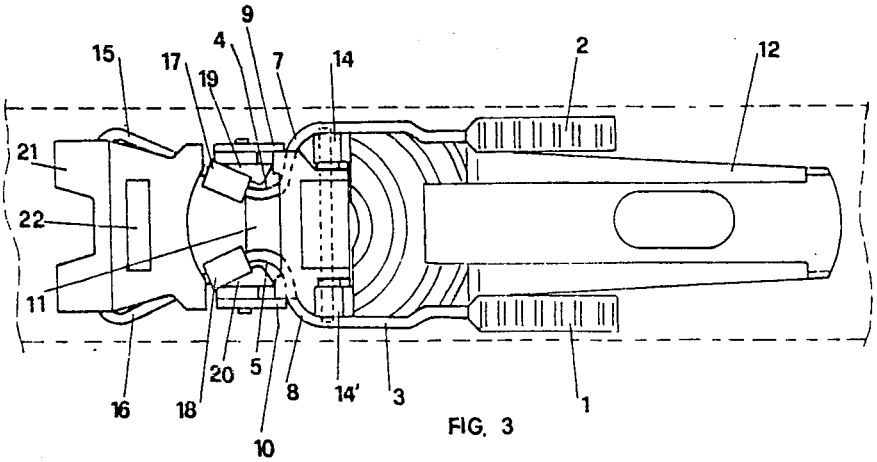
FIG. 3 is a top view of the same.

As shown in FIG. 3, the metallic brace 22, the wings of which have ends 23 and 24 folded towards the interior, makes the shaped plate 21 connected to the end portion of the metallic elastic rod folded in the shape of omega 6. At the same time, the rectilinear portions 15 and 16 are kept free to fold towards the interior under the pressure exerted by shaped cams 19 and 20 integral with the fixed plate 11 on rollers 17 and 18, which idle rollers rotate on the rectilinear portion 15 and 16 of the elastic rod 3.

The advantages according to the present invention are clear if one considers that due to its elasticity and the particular shape of the rod similar to an omega, the arms are compelled to diverge and to rotate downwardly, when following the unhooking of the ski from the foot of the user, the device remains free to rotate on the pivot points provided on the supporting plate, without any necessity of additional elastic elements of every type or other devices.

During the normal skiing operation, the arms 1 and 2 fit totally within the width of the plane of the ski, but are raised substantially with respect to the same plane, and this eliminates any possibility of contact with the snow during the skiing operation, also, in the case of exceptional angular movement.

It is clear that the details of the brake for ski described hereinabove may be varied, while keeping the same essential characteristics of the invention.

What is claimed is:

1. A ski brake of the type having a base with a top surface and binding means for securing the boot of a skier to the top surface of the base, said ski brake comprising:

a frame;

a bracket attached to said frame, said bracket having a pair of upwardly extending shaped wings and a cam member extending inwardly from each shaped wing;

a one piece rod made of flexible, metallic material, said rod having a central omega shaped portion, a pair of rectilinear portions extending rearwardly and inwardly from said omega shaped portion, curved elbow portions extending rearwardly from said rectilinear portions, and end portions extending rearwardly from said elbow portions, thereby forming brake arms, said rectilinear portions being biased outwardly by said omega shaped portion for moving said brake arms outwardly of the ski;

means for pivotally mounting said rod for rotation about said curved elbow portions, said brake arms being movable between a braking position extending below the ski and nonbraking position extending above the ski;

a plastic sleeve surrounding each end portion;

a plate overlying said omega shaped portion and attached thereto; and an idle roller mounted on the rearward end of each rectilinear portion, said cam members exerting an inward force on said idle rollers for moving said brake arms inwardly of the ski when said brake arms are moved to their nonbraking position.

* * * * *